US010054868B2

(12) United States Patent
Kishida et al.

(10) Patent No.: US 10,054,868 B2
(45) Date of Patent: Aug. 21, 2018

(54) CARRIER, TWO-COMPONENT DEVELOPER, DEVELOPER FOR REPLENISHMENT, PROCESS CARTRIDGE, IMAGE FORMING APPARATUS, AND IMAGE FORMING METHOD

(71) Applicants: Hiroyuki Kishida, Shizuoka (JP); Kenichi Mashiko, Shizuoka (JP); Mariko Takii, Kanagawa (JP); Yoshihiro Murasawa, Shizuoka (JP); Haruki Murata, Kanagawa (JP)

(72) Inventors: Hiroyuki Kishida, Shizuoka (JP); Kenichi Mashiko, Shizuoka (JP); Mariko Takii, Kanagawa (JP); Yoshihiro Murasawa, Shizuoka (JP); Haruki Murata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/331,118

(22) Filed: Oct. 21, 2016

(65) Prior Publication Data

US 2017/0153563 A1 Jun. 1, 2017

(30) Foreign Application Priority Data

Nov. 27, 2015 (JP) ..... 2015-231979

(51) Int. Cl.

| | |
|---|---|
| ***G03G 9/113*** | (2006.01) |
| ***G03G 9/10*** | (2006.01) |
| ***G03G 15/08*** | (2006.01) |

(52) U.S. Cl.

CPC ..... *G03G 9/10* (2013.01); *G03G 9/1139* (2013.01); *G03G 15/08* (2013.01)

(58) Field of Classification Search

CPC ..... G03G 9/1139; G03G 15/00

See application file for complete search history.

(56) References Cited

U.S. PATENT DOCUMENTS

| | | | | |
|---|---|---|---|---|
| 4,590,141 | A | 5/1986 | Aoki et al. | |
| 2002/0015905 | A1* | 2/2002 | Isonaka | G03G 9/0906 430/111.35 |
| 2004/0180281 | A1* | 9/2004 | Skorokhod | G03G 9/10 430/111.1 |
| 2011/0091802 | A1* | 4/2011 | Takahashi | G03G 9/1075 430/108.3 |
| 2011/0229817 | A1* | 9/2011 | Yamada | G03G 9/1075 430/111.35 |
| 2012/0028183 | A1 | 2/2012 | Nakajima et al. | |
| 2012/0057898 | A1 | 3/2012 | Sakata et al. | |

(Continued)

FOREIGN PATENT DOCUMENTS

| | | |
|---|---|---|
| JP | 55-127569 | 10/1980 |
| JP | 55-157751 | 12/1980 |

(Continued)

OTHER PUBLICATIONS

Publication of JP 2006-018129 published Jan. 2006.*
U.S. Appl. No. 06/479,406, filed Mar. 28, 1983.

*Primary Examiner* — Peter L Vajda
(74) *Attorney, Agent, or Firm* — Oblon, McClelland, Maier & Neustadt, L.L.P.

(57) ABSTRACT

A carrier includes a core and a covering layer covering the core and including at least carbon black and a filler. The maximum height Ry of the surface of the carrier is from 4.0 μm to 5.0 μm.

14 Claims, 2 Drawing Sheets

(56) References Cited

U.S. PATENT DOCUMENTS

| | | | | |
|---|---|---|---|---|
| 2012/0058423 | A1 | 3/2012 | Yamaguchi et al. | |
| 2012/0064451 | A1 | 3/2012 | Kishida et al. | |
| 2012/0129087 | A1* | 5/2012 | Iwami | G03G 9/107 430/106.2 |
| 2012/0230725 | A1 | 9/2012 | Sakata et al. | |
| 2013/0004209 | A1 | 1/2013 | Kishida et al. | |
| 2013/0016999 | A1 | 1/2013 | Tohmatsu et al. | |
| 2013/0252160 | A1 | 9/2013 | Nagayama et al. | |
| 2013/0252169 | A1 | 9/2013 | Yaguchi et al. | |
| 2014/0072910 | A1 | 3/2014 | Iwatsuki et al. | |
| 2015/0153665 | A1 | 6/2015 | Kishida et al. | |

FOREIGN PATENT DOCUMENTS

| | | | | |
|---|---|---|---|---|
| JP | 56-140358 | | 11/1981 | |
| JP | 57-096355 | | 6/1982 | |
| JP | 57-096356 | | 6/1982 | |
| JP | 58-207054 | | 12/1983 | |
| JP | 61-110161 | | 5/1986 | |
| JP | 62-273576 | | 11/1987 | |
| JP | 6-011907 | | 1/1994 | |
| JP | 7-140723 | | 6/1995 | |
| JP | 8-179570 | | 7/1996 | |
| JP | 8-286429 | | 11/1996 | |
| JP | 10-171169 | | 6/1998 | |
| JP | 2005-148179 | | 6/2005 | |
| JP | 2006-018129 | * | 1/2006 | G03G 9/113 |
| JP | 2006-079022 | | 3/2006 | |
| JP | 2008-262155 | | 10/2008 | |
| JP | 2009-186769 | | 8/2009 | |
| JP | 2009-251483 | | 10/2009 | |
| JP | 2010-282168 | | 12/2010 | |

* cited by examiner

CARRIER, TWO-COMPONENT DEVELOPER, DEVELOPER FOR REPLENISHMENT, PROCESS CARTRIDGE, IMAGE FORMING APPARATUS, AND IMAGE FORMING METHOD

CROSS-REFERENCE TO RELATED APPLICATIONS

This patent application is based on and claims priority pursuant to 35 U.S.C. § 119 to Japanese Patent Application No. 2015-231979, filed on Nov. 27, 2015, in the Japan Patent Office, the entire disclosure of which is hereby incorporated by reference herein.

BACKGROUND

Technical Field

The present invention relates to a carrier, a two-component developer, a developer for replenishment, a process cartridge, an image forming apparatus, and an image forming method.

Description of the Related Art

Electrophotographic image forming methods include forming an electrostatic latent image on an image bearer such as a photoconductive material, transferring a charged toner thereto to form a toner image, transferring the toner image onto a recording medium such as paper, and fixing the toner image thereon to form a final output image. Recently, electrophotographic copiers and printers are rapidly developing from monochrome to full-color, and full-color markets are expanding.

The electrophotographic image forming methods typically include overlaying three primary color toners, i.e., yellow, magenta, and cyan toners, or four color toners including the above-described three toners and black toner, to reproduce all colors. Therefore, to produce a sharp full-color image having good color reproducibility, the surface of a fixed toner image has to be smooth to reduce light scattering. This is why many conventional full-color copiers produce images having medium to high glossiness of from 10% to 50%.

As a method of fixing a dry toner image on a recording medium, contact heat fixing methods using a heated roller or a heated belt having a smooth surface are typically used. Although the methods have high heat efficiency, and are capable of fixing at high speed while imparting gloss and transparency to color toners, offset problems do occur, wherein a part of a toner image adheres to a fixing member and then is transferred to another image, during separation of the fixing member from the melted toner image after pressing the surface of the fixing member.

For the purpose of preventing offset problems, the surface of the fixing member has typically been coated with silicone rubber or a fluorine-containing resin. Further, a releasing agent in the form of an oil such as silicone oil is applied to the surface of the fixing member. Although this approach is quite effectively used to prevent offset problems, a release oil applicator is required and the resultant fixer becomes larger.

Therefore, as an alternative, there are oilless arrangements or systems that apply only a small amount of oil. Such system use a monochrome toner having high viscoelasticity when melted so as not to break down internally, and including a release agent such as wax.

In addition, even full-color image forming apparatuses are becoming oilless as well for the purpose of downsize and simplification of the fixer. However, as mentioned above, to improve color reproducibility of a color toner, the color toner needs to have lower viscoelasticity because the fixed color toner image is required to have a smooth surface. Therefore, the color toner has offset problems more often than the monochrome toner does, making it more difficult to make a fixer oilless or use only a small amount of oil. In addition, a toner including a release agent has higher adherence to an image bearer and lower transferability to a transfer paper. Further, the release agent therein contaminates friction-charged members such as a carrier and lowers the chargeability thereof, resulting in deterioration of durability of the toner.

On the other hand, for the purpose of preventing toner constituents from filming, making the surface thereof uniform, preventing oxidization thereof, preventing deterioration of moisture sensitivity thereof, extending lives of developers, preventing adherence of the carriers to the surfaces of photoreceptors, protecting photoreceptors from being damaged or abraded by the carriers, controlling charge polarity thereof and controlling charge quantity thereof, a resin having a low surface energy such as fluorine-containing resins and silicone resins is applied on the carrier core material to prolong the life of the carrier.

However, recently, image forming apparatuses have been desired to further downsize, to reduce environmental load that tends to increase due to longer life, to stably produce quality images for long periods, and to reduce cost of producing one image. Therefore, a carrier having higher durability is required. This is because a compact image forming apparatus includes an image developer containing a developer less and a carrier thereof receives stress more.

Properties of the carrier need to be kept stable for a long period of times to produce quality images for a long period of time. Particularly, a resistance value which is the main property of the carrier is preferably maintained. Carbon black has conventionally and preferably been used to control the resistance value of the carrier because a small amount of carbon black can control the resistance value at low cost. However, when the carbon black is transferred to the toner, an image which is somewhat black is produced. Therefore, carbon black needs to skillfully be used to produce full-color images.

SUMMARY

A carrier includes a core and a covering layer covering the core and including at least carbon black and a filler. The maximum height Ry of the surface of the carrier is from 4.0 μm to 5.0 μm.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1:
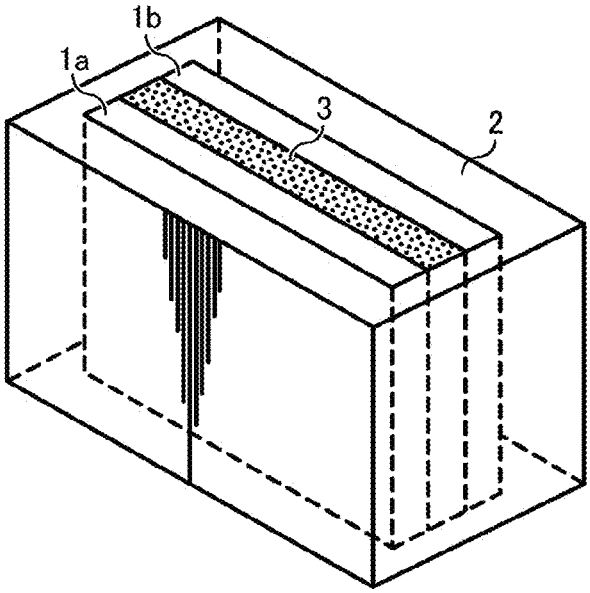
FIG. 1 is a schematic view illustrating a cell for use in measuring a specific volume resistivity of a carrier of the present invention.

Accordingly, one object of the present invention is to provide a highly durable carrier capable of producing high-quality images, which is preferably usable for two-component developers in electrophotographies and electrostatic recordings.

Another object of the present invention is to provide a two-component developer including the carrier.

A further object of the present invention is to provide a developer for replenishment including the carrier.

Another object of the present invention is to provide a process cartridge using the two-component developer.

A further object of the present invention is to provide an image forming apparatus using the two-component developer.

Another object of the present invention is to provide an image forming method using the two-component developer.

The present disclosure combines carbon black and a filler to increase strength of the covering layer and specifies the maximum height of the surface of the covering layer to prevent carbon black from transferring to the toner.

The present inventors found a combination of carbon black and a filler increase strength of the covering layer more than carbon black or the filler alone. The reason is not clarified, but it is assumed that terminals of the filler and carbon black interact each other to form a two-dimensional network.

Further, carbon black preferably has a DBP oil absorption not less than 400 ml/100 g, and more preferably not less than 500 mL/100 g. The DBP oil absorption is a parameter representing a branching degree of carbon black structure. The larger the value, the more branched the structure. When less than 400 ml/100 g, the covering layer does not have sufficient strength and is abraded as time passes, which may cause solid carrier adherence due to lowering of resistivity. The DBP oil absorption is measured according to JIS K 6217.

In the present disclosure, the filler preferably has a particle diameter of from 400 nm to 800 nm, and more preferably from 500 nm to 700 nm. The fillers having a specific size more frequently contact each other when the carriers contact each other to suppress the covering layer from being abraded. When less than 400 nm, the filler is buried in the covering layer and particles forming convexities on the surface of the carrier. Therefore, the covering layers are rubbed when the carriers contact each other, resulting in possible solid carrier adherence due to lowering of resistivity. When larger than 800 nm, larger concavities and convexities on the surface of the carrier accelerates abrasion of the covering layer, resulting in possible solid carrier adherence due to lowering of resistivity as time passes. In addition, the fillers are caught in with each other and release from the covering layer, resulting in possible fragile film.

The particle diameter of the filler can be measured by e.g., Nanotrac UPA-EX150 from Nikkiso Co., Ltd.

In the present disclosure, the maximum height Ry of the surface of the carrier is essentially from 4.0 μm to 5.0 μm.

Figure 3:
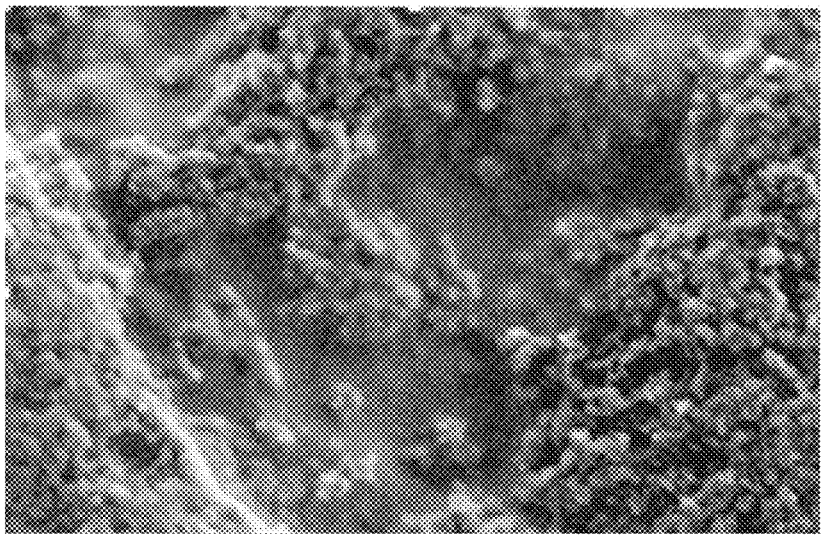
FIG. 3 is a photograph of the surface of the carrier of the present invention before being smoothed.
Figure 4:
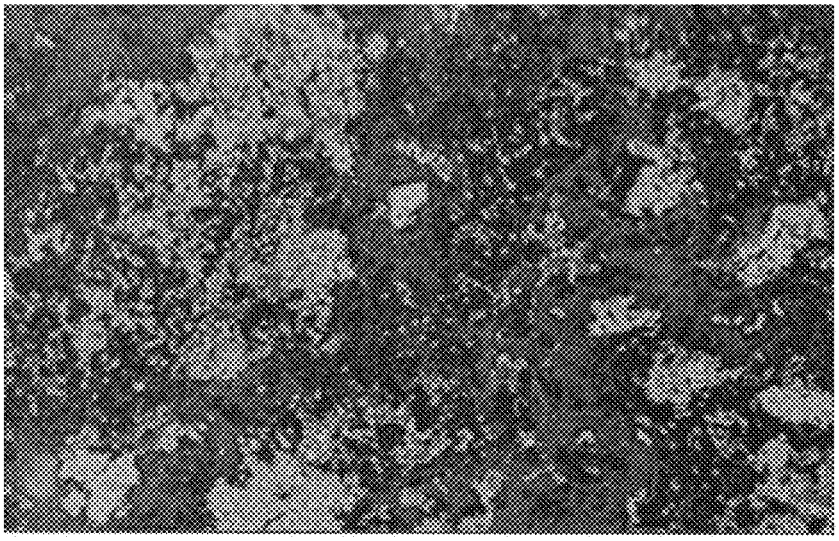
FIG. 4 is a photograph of the surface of the carrier of the present invention after being smoothed.

The maximum height Ry is the sum of a height of the highest peak from an average line and a depth of the lowest valley from an average line, and an index of degree of convexities and concavities on the surface of the carrier. The maximum height Ry can be measured according to JIS-B0601 (1994). A carrier coated with a covering layer including carbon black and burnt has a lump of the carbon black as shown in FIG. 3. When a carrier having the lump is filled in an image forming apparatus, the carriers contact each other therein and the lump of the carbon black releases from the surface of the carrier. The released carbon black contacts a toner and transfers thereto. The toner forms a blackish image.

In order to prevent a toner from being contaminated, the present inventor applies a mechanical stress to a carrier after burnt to remove the lump of the carbon black. They found that a toner is not contaminated when the maximum height Ry of the surface of the carrier is from 4.0 μm to 5.0 μm.

When less than 4.0 μm, the carbon black is fully removed, but hazard to the covering layer is large. Therefore, the covering layer is fragile and the resistivity lowers as time passes, resulting in solid carrier adherence. When higher than 5.0 μm, the carbon black is not fully removed and the toner is contaminated.

Methods of removing carbon black on the surface of the covering layer include a method of removing carbon black from the carrier alone and a method of mixing a small amount of the toner with the carrier to remove carbon black. The latter more effectively removes carbon black.

Turbular mixers, all-around stirrers, Rhedige mixers, Henschel mixers, image developers and locking mills can apply mechanical stress, and the locking mills are preferably used.

The carrier preferably has a volume-average particle diameter of from 32 μm to 40 μm. When less than 32 μm, carrier adherence may occur. When greater than 40 μm, reproducibility of image details deteriorates, and high definition images may not be formed.

The volume-average particle diameter can be measured by using a micro-track particle size distribution tester, model HRA9320-X100 (manufactured by Nikkiso Co., Ltd.). The carrier of the present embodiment preferably has a specific volume resistivity of from 8 Log Ω·cm to 14 Log Ω·cm. When less than 8 Log Ω·cm, non-image area may have carrier adherence. When greater than 14 Log Ω·cm, edge effect may not be acceptable.

Additionally, the volume resistivity can be measured by using a cell shown in FIG. 1. Specifically, first, in a cell composed of a fluorine resin container (2) where an electrode (1*a*) and electrode (1*b*) of surface area 2.5 cm×4 cm are accommodated at a distance of 0.2 cm, a carrier (3) is filled, and tapped 10 times at a tapping speed of 30 times/min from a dropping height of 1 cm. Next, direct voltage of 1000 V was applied between the electrodes (1*a*) and (1*b*), and resistance r [Ω] after 30 seconds is measured by using a high-resistance meter 4329A (manufactured by Yokogawa Hewlett-Packard Co., Ltd.), and volume resistivity [Ω·cm] can be calculated from the following formula.

$$r\times(2.5\times4)/0.2$$

A covering resin included in the covering layer of the carrier includes silicone resins, acrylic resins or their combination. They are combined because of the following reasons. The acrylic resins have high adhesivenss and low fragility, and therefore has very good abrasion resistance. However, having high surface energy, when combined with a toner likely to be spent, the acrylic resins may cause low charge quantity due to accumulation of spent toner components. Therefore, silicone resins having low surface energy and less accumulation of spent toner components are combined to solve this problem. However, the silicone resins have low adhesivenss and high fragility, and therefore has poor abrasion resistance. It is preferable to balance the properties of the two resins to obtain a covering layer having less spent and abrasion resistance.

The silicone resin is appropriately selected from silicone resins commonly known in the art depending on the intended purpose without any limitation, and examples thereof include a straight silicone resin constituted of organosiloxane bonds; and a modified silicone resin, which is modified with an alkyd resin, a polyester resin, an epoxy resin, an acryl resin, or a urethane resin. The silicone resin can be selected from commercial products. Examples of commercial products of the straight silicone resin include: KR271, KR255, and KR152 from Shin-Etsu Chemical Co., Ltd.; and SR2400, SR2406, and SR2410 from Dow Corning Toray Co., Ltd. As for the modified silicone resin, commercial products thereof can be used. Examples of the commercial products thereof include: KR206 (alkyd-modified), KR5208 (acryl-modified), ES1001N (epoxy-modified), and KR305 (urethane-modified) from Shin-Etsu Chemical Co., Ltd.; and SR2115 (epoxy-modified), SR2110 (alkyd-modified) from Dow Corning Toray Co., Ltd.

Acrylic copolymers formed of the following monomers A, B and C may be used as the covering resin as well.

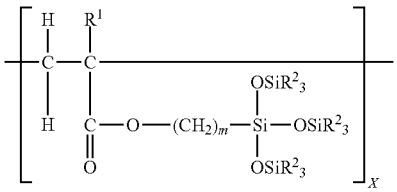

A Part (from Monomer A Component)
wherein $R^1$ represents a hydrogen atom or a methyl group; $R^2$ represents an alkyl group having 1 to 4 carbon atoms; m is preferably from 1 to 8; and X is preferably from 10 to 40.

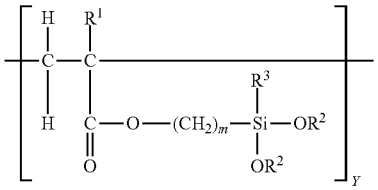

B Part (from Monomer B Component)
wherein $R^1$ represents a hydrogen atom or a methyl group; $R^2$ represents an alkyl group having 1 to 4 carbon atoms; $R^3$ represents an alkyl group having 1 to 8 carbon atoms, or an alkoxy group having 1 to 4 carbon atoms; m is preferably from 1 to 8; and Y is preferably from 10 to 40.

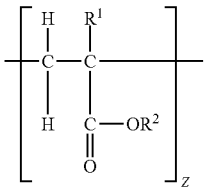

C Part (from Monomer C Component)
wherein $R^1$ represents a hydrogen atom or a methyl group; $R^2$ represents an alkyl group having 1 to 4 carbon atoms; and Z is preferably from 30 to 80.

As a catalyst for condensation polymerization, a titanium catalyst, tin catalyst, zirconium catalyst and aluminum catalyst are listed, but the present disclosure is based on the finding that among various kinds of these catalysts, of titanium catalyst bringing a good result, in particular, titanium alkoxide and titanium chelate give the most preferable result as a catalyst. It is thought that this catalyst has a large effect to promote condensation reaction of silanol group and is hard to deactivate.

The acrylic resin in the present disclosure is not particularly limited and includes all resins having acrylic components. The acrylic resin can be used alone or in combination with other crosslinking components. Specific examples of the other crosslinking components include, but are not limited to, amino resins and acidic catalysts. Specific examples of the amino resins include, but are not limited to, guanamine and melamine resins. Specific examples of the acidic catalysts include any known materials causing catalysis. Specific examples thereof include, but are not limited to, materials having a reactive group such as complete alkyl groups, methylol groups, imino groups, methylol/imino groups.

Further, the covering layer preferably includes a crosslinked material of an acrylic resin and an amino resin.

The covering layer including the crosslinked material can suppress the covering layers from fusion bonding with each other while maintaining suitable elasticity.

Specific examples of fillers used in the present disclosure include titanium oxide, tin oxide, zinc oxide, alumina, barium sulfide, magnesium oxide, magnesium hydroxide, hydrotalcite, etc. These may be used alone or in combination. Among these barium sulfide, hydrotalcite, and magnesium oxide are preferably used.

The filler is dispersed in the covering layer of the carrier to protect the covering layer from an outer force applied to the surface of the carrier. When the filler is easy to crack or abrade when an external force is added thereto, the covering layer is initially protected, but is not maintained for long periods, resulting in unstable quality. Having toughness, the filler in the present disclosure has resistance to the external force, is not cracked or abrade, and protects the covering layer for long periods.

The filler is preferably present in the acrylic resin in the covering layer. This is because the acrylic resin having high adhesiveness is able to hold the filler for long periods. However, the filler is not necessarily present in the acrylic resin.

The content of the filler is preferably from 0.1 parts by mass to 1,000 parts by mass, and more preferably from 70 parts by mass to 700 parts by mass per 100 parts by mass of the covering resin included in the covering layer.

Specific example of the amino resin include, but are not limited to, melamine resins and benzoguanamine resins capable of improving chargeability of the carrier. When chargeability of the carrier needs controlling, other amino resins may be used with the melamine resin and/or the benzoguanamine resins.

The acrylic resin capable of crosslinking with the amino resin preferably has a hydroxyl group and/or a carboxyl group, and more preferably has a hydroxyl group. This further improves adhesivenss between the particulate core material and the electroconductive particulate material, and dispersion stability of the electroconductive particulate material. The acrylic resin preferably has a hydroxyl value not less than 10 mg KOH/g, and more preferably not less than 20 mg KOH/g.

In the present disclosure, the covering layer preferably includes a silane coupling agent to stably disperse the filler.

Specific examples of the silane coupling agent include, but are not limited to, γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl [3-(trimethoxysilyl)propyl]ammonium chloride, γ-chloropropylmethyldimethoxysilane, methyltrichlorosilane, dimethyldichlorosilane, trimethylchlorosilane, allyltriethoxysilane, 3-aminopropylmethyldiethoxysilane, 3-aminopropyltrimethoxysilaene, dimethyldiethoxysilane, 1,3-divinyltetramethyldisilazane, methacryloxyethyldimethyl(3-trimethoxysilylpropyl)ammonium chloride etc. These may be used alone or in combination.

Specific examples of commercial products of the silane coupling agent include AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, Z-6940 (manufactured by Toray Silicone Co., Ltd.), etc.

The content of the silane coupling agent is preferably from 0.1% by mass to 10% by mass relative to silicone resin. When less than 0.1% by mass, adhesiveness among a core material, the filler and the silicone resin lowers, and the covering layer may be detached in a prolonged use, whereas when more than 10% by mass, filming of toner occurs sometimes in a prolonged use.

In the present disclosure, the covering layer preferably has a thickness of from 0.1 μm to 1.0 μm, and more preferably from 0.2 μm to 0.8 μm.

The covering layer preferably includes the filler in an amount of from 10% by mass to 40% by mass, and more preferably from 20% by mass to 30% by mass.

The covering layer preferably includes the carbon black in an amount of from 0.1% by mass to 1.0% by mass, and more preferably from 0.2% by mass to 0.8% by mass.

In the present disclosure, the core material is not particularly limited as long as it is a magnetic material, and specific examples thereof include electromagnetic materials such as iron and cobalt; iron oxide such as magnetite, hematite and ferrite; various kinds of alloys or compounds; resin particles in which these magnetic materials are dispersed, etc. Above all, in consideration of environment, Mn ferrite, Mn—Mg ferrite, Mn—Mg—Sr ferrite, etc. are preferably used.

The two-component developer of the present embodiment has the carrier and toner of the present embodiment.

The toner contains a binding resin and a colorant, may be either of a monochrome toner and a color toner. The toner may contain a release agent in order to be applied to an oil-free system where oil for preventing toner from adhesion to a fixing roll is not coated. In general, such toner tends to generate filming, but since the carrier of the present embodiment can prevent filming, the developer of the present embodiment can maintain a good quality over a long period of time.

Further, color toner, particularly, yellow toner generally has a problem that color smear occurs due to scraping of the coating layer of carrier, but the two-component developer of the present embodiment can suppress occurrence of color smear.

A toner can be prepared by known methods such as pulverization methods and polymerization methods. For example, when a toner is prepared by the pulverization methods, first, a melt-kneaded material obtained by kneading toner raw materials is cooled, then, pulverized and classified to prepare a base particle. Next, in order to improve transferability and durability, an external additive is added to the base particle, thereby preparing a toner.

Specific examples of apparatuses for kneading toner raw materials include, but are not limited to, two rolls of batch type; BANBURY mixer; a continuous biaxial extruder such as KTK-type biaxial extruder (manufactured by Kobe Steel, Ltd.), TEM-type biaxial extruder (manufactured by Toshiba Machine Co., Ltd.), biaxial extruder (manufactured by KCK Corporation), PCM-type biaxial extruder (manufactured by Ikegai Co., Ltd.), KEX-type biaxial extruder (manufactured by Kurimoto, Ltd.); and a continuous uniaxial kneader such as co-kneader (manufactured by Buss Corporation).

In pulverizing a melt-kneaded material cooled, after it was coarsely crushed with a hammer mill, ROTOPLEX or the like, then, can be finely pulverized with a fine pulverizing mill using jet stream, a mechanical fine pulverizing mill or the like. Additionally, it is preferable to pulverize such that the resultant fine particles have an average particle diameter of from 3 μm to 15 μm.

Further, in classifying the melt-kneaded material pulverized, a wind-type classifying machine or the like can be used. Additionally, it is preferable to classify the material such that the base particles have an average particle diameter of from 5 μm to 20 μm.

In adding an external additive to the base particle, by mixing and stirring using mixers, the external additive adheres to the surface of the base particle while pulverized.

Specific examples of the binder resin include, but are not limited to, polymer of styrene and its derivative such as polystyrene, polyp-styrene and polyvinyltoluene; a styrene copolymer such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-maleate copolymer; polymethyl methacrylate, polybutyl methacrylate, polyvinylchloride, polyvinyl acetate, polyethylene, polyester, polyurethane, epoxy resin, polyvinyl butyral, polyacrylic acid, rosin, modified rosin, terpene resin, phenolic resin, aliphatic or aromatic hydrocarbon resin, aromatic petroleum resin, and their combinations Specific examples of the binder resin for pressure-fixing include, but are not limited to, polyolefin such as low-molecular weight polyethylene and low-molecular weight polypropylene; olefin copolymer such as ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer and ionomer resin; epoxy resin, polyester, styrene-butadiene copolymer, polyvinylpyrrolidone, methyl vinyl ether-anhydrous maleic acid copolymer, maleic acid-modified phenolic resin, phenol-modified terpene resin, and their combinations.

Specific examples of the colorant (pigment or dye) include, but are not limited to, and there are listed a yellow pigment such as cadmium yellow, mineral fast yellow, nickel titanium yellow, Naples yellow, naphthol yellow S, Hansa yellow G Hansa yellow 10G benzidine yellow GR, quinoline yellow lake, permanent yellow NCG and tartrazine lake; an orange pigment such as molybdenum orange, permanent orange GTR, pyrazolone orange, Vulcan orange, indanthrene brilliant orange RK, benzidine orange G and indanthrene brilliant orange GK; a red pigment such as iron red, cadmium red, permanent red 4R, lithol red, pyrazolone red, watching red calcium salt, lake red D, brilliant carmine 6B, eosin lake, rhodamine lake B, alizarin lake and brilliant carmine 3B; a violet pigment such as fast violet B and methyl violet lake; a blue pigment such as cobalt blue, alkali blue, Victoria blue lake, phthalocyanine blue, non-metal phthalocyanine blue, phthalocyanine blue-partly chloride, fast sky blue and indanthrene blue BC; a green pigment such as chromium green, chromium oxide, pigment green B and malachite green lake; a black pigment including carbon black, oil furnace black, channel black, lamp black, acetylene black, an azine color such as aniline black, metal salt azo color, metal oxide, complex metal oxide, and their combinations.

Specific examples of the release agent include, but are not limited to, polyolefin such as polyethylene and polypropylene, fatty acid metal salt, fatty acid ester, paraffin wax, amide wax, polyhydric wax, silicone varnish, carnauba wax and ester wax, and their combinations.

The toner may further include a charge controlling agent. Specific examples of the charge controlling agent include, but are not limited to, nigrosine; an azine dye having an alkyl group having 2 to 16 carbon atoms (see Japanese Examined Patent Publication No. JP-S42-1627-A); a basic dye such as C.I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040) and C. I. Basic Green 4 (I. C. 42000); and a lake pigment of these basic dyes; a quaternary ammonium salt such as C. I. Solvent Black 8 (C. I. 26150), benzoyl methyl hexadecyl ammonium chloride and decyltrimethyl chloride; a dialkyl tin compound such as dibutyl and dioctyl; a dialkyl tin borate compound; a guanidine derivative; a polyamine resin such as vinyl polymer having an amino group and condensation polymer having an amino group; a metal complex salt of monoazo dye described in Japanese Examined Patent Publications Nos. JP-S41-20153-A, JP-S43-27596-A, JP-S44-6397-A and JP-S45-26478-A; salicylic acid described in Japanese Examined Patent Publications Nos. JP-S55-42752-A and JP-S59-7385-A; a metal complex with Zn, Al, Co, Cr, Fe, etc. of dialkyl salicylic acid, naphthoic acid and dicarboxylic acid; a sulfonated copper phthalocyanine pigment; organic boron acid slats; fluorine-containing quaternary ammonium salt; calixarene compound etc., and two kinds or more may be concomitantly used. Additionally, in a color toner other than black, a white metal salt of salicylic acid derivative is preferable used.

Specific examples of the external additive include, but are not limited to, an inorganic particle such as silica, titanium oxide, alumina, silicon carbide, silicon nitride and boron nitride; a resin particle such as polymethyl methacrylate particle with an average particle diameter of 0.05 μm to 1 μm obtained by a soap-free emulsion polymerization technique and a polystyrene particle, and two kinds or more may be concomitantly used. Above all, preferable are silica and a metal oxide particle such as titanium oxide, whose surface is subjected to hydrophobic treatment. Further, in concomitant use of silica subjected to hydrophobic treatment and titanium oxide subjected to hydrophobic treatment, by setting the addition amount of titanium oxide subjected to hydrophobic treatment more than that of silica subjected to hydrophobic treatment, a toner excellent in charge stability to humidity is obtained.

When a developer for replenishment including the carrier of the present embodiment and a toner is used in an image forming apparatus forming an image while discharging an excessive developer in the image developer, images having stable image quality are produced for quite long periods. Namely, the carrier deteriorated in the image developer is replaced with the carrier which is not deteriorated in the developer for replenishment to stably maintain charge quantity and produce images having stable image quality for long periods. This method is effectively used to print images having large image areas. When images having large image areas are produced, the carrier mainly deteriorates due to toner spent on the carrier. This method provides more carrier when producing images having large image areas and the deteriorated carrier is more frequently replaced. This is why images having stable image quality are produced for quite long periods.

The developer for replenishment preferably includes a toner in an amount of from 2 parts by mass to 50 parts by mass relative to 1 part by mass of the carrier. When less than 2 parts by mass, a concentration of the carrier in the image developer is so high that the developer is likely to increase in charge quantity. When the developer increases in charge quantity, developability and the image density decrease. When greater than 50 parts by mass, the carrier in the image developer is replaced less, and effect against carrier deterioration is not expected.

The image forming apparatus of the present embodiment includes an electrostatic latent image bearer, a charger to charge the electrostatic latent image bearer, an irradiator to irradiate the electrostatic latent image bearer to form an electrostatic latent image thereon, an image developer to develop the electrostatic latent image with the two-component developer of the present embodiment to form a toner image, a transferer to transfer the toner image onto a recording medium, and a fixer to fix the toner image on the recording medium.

The image forming method of the present embodiment includes process of forming an electrostatic latent image on an electrostatic latent image bearer, a process of developing the electrostatic latent image with the two-component developer of the present embodiment to form a toner image, a process of transferring the toner image onto a recording medium, and a fixing process of fixing the toner image on the recording medium.

The process cartridge of the present embodiment includes an electrostatic latent image bearer, a charger to charge the surface of the electrostatic latent image bearer, an image developer to develop the latent image with the two-component developer of the present embodiment, and a cleaner to clean the electrostatic latent image bearer.

Figure 2:
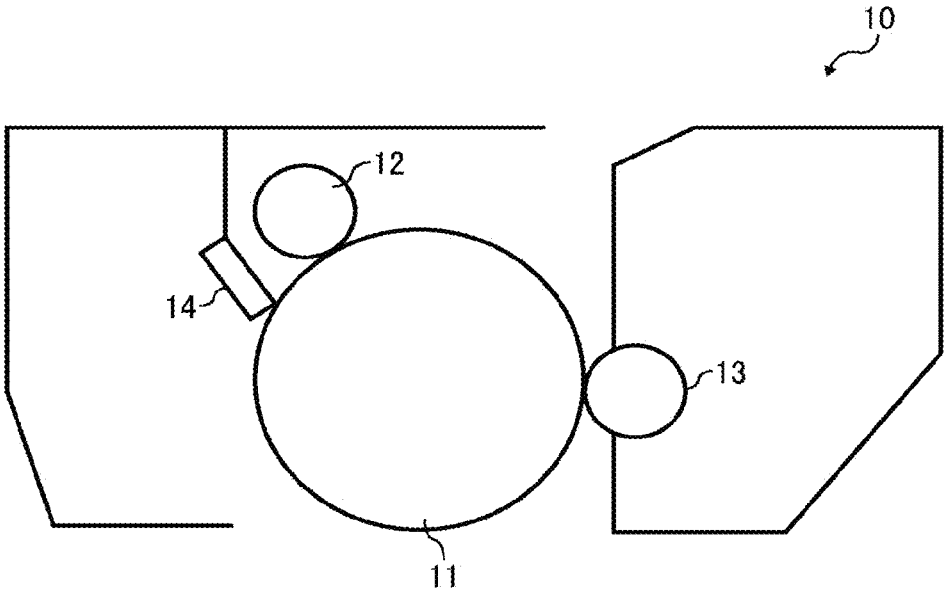
FIG. 2 is a schematic view illustrating an embodiment of the process cartridge of the present invention.

FIG. 2 is a schematic view illustrating an embodiment of the process cartridge of the present embodiment. A process cartridge (10) is integrated by a photosensitive body (11), a charging device (12) for charging the photosensitive body (11), a development device (13) for forming a toner image by developing an electrostatic latent image formed on the photosensitive body (11) using a developer of the present embodiment, and a cleaning device (14) for removing the toner let on photosensitive body (11) after transferring the toner image formed on the photosensitive body (11) to a recording medium, and the process cartridge (10) is detachable from a main body of an image forming device such as facsimile and printer.

Hereinafter, a method for forming an image using an image forming device that a process cartridge (10) is mounted is explained. First, a photosensitive body (11) is driven and rotated at a predetermined circumferential velocity, by a charging device (12), the circumferential surface of photosensitive body (11) is uniformly charged at a predetermined positive or negative potential. Next, from an exposure device (not shown in the figure) such as exposure device of slit exposure system and exposure device of scanning exposure by laser beam, exposure light is irradiated onto the circumferential surface of photosensitive body (11) to form an electrostatic latent image sequentially. Further, the electrostatic latent image formed on the circumferential surface of photosensitive body (11) is developed by a development device (13) using a developer of the present embodiment to form a toner image. Next, the toner image formed on the circumferential surface of photosensitive body (11) is synchronized with the rotation of photosensitive body (11), and transferred sequentially to a transfer paper fed between the photosensitive body (11) and a transfer device (not shown in the figure) from a paper feeding part (not shown in the figure). Further, the transfer paper that the toner image was transferred is separated from the circumferential surface of photosensitive body (11) and introduced into a fixing device (not shown in the figure) and fixed, then, printed out to the outside of the image forming device as a copy. On the other hand, regarding the surface of photosensitive body (11) after the toner image is transferred, the residual toner is removed for cleanup by a cleaning device (14), then it is discharged by a discharging device (not shown in the figure) to use for image formation repeatedly.

EXAMPLES

Having generally described this invention, further understanding can be obtained by reference to certain specific examples which are provided herein for the purpose of illustration only and are not intended to be limiting. In the descriptions in the following examples, the numbers represent mass ratios in parts or %, unless otherwise specified.

(Core Material Preparation Method)

A mixture of $MnCO_3$, $Mg(OH)_2$ and $Fe_2O_3$ was pre-burnt at 900° C. for 3 hours in the atmosphere using a heating oven, followed by cooling and pulverization to prepare a powder having a diameter about 1 μm. Water and a dispersant in an amount of 1% by weight were added to the powder to prepare a slurry, and the slurry was fed to a spray dryer to prepare a granulated material having an average particle diameter of 40 μm.

The granulated material was placed in a firing furnace and burnt at 1,250° C. for 5 hrs under a nitrogen atmosphere. The burnt material was pulverized by a pulverizer and classified with a sieve to prepare a spherical ferrite particle C1 having a volume-average particle diameter about 35 μm.

The volume-average particle diameter was measured by using a micro-track particle size distribution tester, model HRA9320-X100 (manufactured by Nikkiso Co., Ltd.) in water with a material refractive index of 2.42, a solvent refractive index of 1.33 and a concentration of 0.06.

Carrier Preparation Example 1

The following materials were dispersed by a homomixer for 10 min to obtain a covering layer forming solution.

| | |
|---|---|
| Silicone Resin Solution [Solid content of 20% by mass (SR2410 from Dow Corning Toray Silicone Co., Ltd.)] | 500 |
| Titanium Catalyst [Solid content of 60% by mass (TC-754 from Matsumoto Fine Chemical Co., Ltd.)] | 20 |
| Aminosilane [Solid content of 100% by mass (SH6020 from Dow Corning Toray Silicone Co., Ltd.)] | 3.2 |
| Barium Sulfate (Sedimentary barium sulfate 110 having a particle diameter of 600 nm from Sakai Chemical Industry Co., Ltd.) | 130 |
| Carbon Black (EC300J having a DBP oil absorption 360 ml/100 g from Lion Corp.) | 2 |
| Toluene | 1,000 |

The covering layer forming solution was coated on 5,000 parts of C1 by SPIRA COTA (from Okada Seiko Co., Ltd.) at a an inner temperature of 55° C. and dried. The resultant carrier was burnt in an electric oven at 200° C. for 1 hr. After cooled, the ferrite powder bulk was sieved through openings of 63 μm. The carrier and a toner (2% by mass) were placed in a vial, and stirred by a locking mill from Seiwa Giken Co., Ltd. at 60 Hz for 6 hrs. The toner was removed from the mixture to prepare a carrier 1 having an Ry of 4 μm, a volume-average particle diameter of 36 μm, and a specific volume resistivity of 12 Log Ω·cm.

The surface of the carrier was observed with a confocal microscope OPTELICS C130 from Lasertec Corp. (eye lens: 50 times, image resolution: 0.44 μm, Imaging Mode: Max Peak) to obtain a three-dimensional image.

Ry values within a radius of 12 μm of the carrier image were analyzed. 50 Ry values were averaged.

The volume-average particle diameter was measured by using a micro-track particle size distribution tester, model HRA9320-X100 (manufactured by Nikkiso Co., Ltd.) in water with a material refractive index of 2.42, a solvent refractive index of 1.33 and a concentration of 0.06.

The volume resistivity was measured by using a cell shown in FIG. 1. In a cell composed of a fluorine resin container (2) where an electrode (1*a*) and electrode (1*b*) of surface area 2.5 cm×4 cm were accommodated at a distance of 0.2 cm, a carrier (3) was filled, and tapped 10 times at a tapping speed of 30 times/min from a dropping height of 1 cm. Next, direct voltage of 1000 V was applied between the electrodes (1*a*) and (1*b*), and resistance r [Ω] after 30 seconds was measured by using a high-resistance meter 4329A (manufactured by Yokogawa Hewlett-Packard Co., Ltd.), and the volume resistivity [Ω·cm] was calculated from the following formula.

$$r\times(2.5\times4)/0.2$$

Carrier Preparation Example 2

The following materials were dispersed by a homomixer for 10 min to obtain a covering layer forming solution.

| | |
|---|---|
| Silicone Resin Solution [Solid content of 20% by mass (SR2410 from Dow Corning Toray Silicone Co., Ltd.)] | 500 |
| Titanium Catalyst [Solid content of 60% by mass (TC-754 from Matsumoto Fine Chemical Co., Ltd.)] | 20 |
| Aminosilane [Solid content of 100% by mass (SH6020 from Dow Corning Toray Silicone Co., Ltd.)] | 3.2 |
| Barium Sulfate (B-30 having a particle diameter of 300 nm from Sakai Chemical Industry Co., Ltd.) | 130 |
| Carbon Black (LIONITE CB having a DBP oil absorption 400 ml/100 g from Lion Corp.) | 2 |
| Toluene | 1,000 |

The covering layer forming solution was coated on 5,000 parts of C1 by SPIRA COTA (from Okada Seiko Co., Ltd.) at a an inner temperature of 60° C. and dried. The resultant carrier was burnt in an electric oven at 200° C. for 1 hr. After cooled, the ferrite powder bulk was sieved through openings of 63 μm. The carrier and a toner (2% by mass) were placed in a vial, and stirred by a locking mill from Seiwa Giken Co., Ltd. at 60 Hz for 6 hrs. The toner was removed from the mixture to prepare a carrier 2 having an Ry of 4 μm, a volume-average particle diameter of 36 μm, and a specific volume resistivity of 12 Log Ω·cm.

Carrier Preparation Example 3

The procedure for preparation of the carrier 2 in Carrier Preparation Example 2 was repeated except for replacing the barium sulfate with B-35 having a particle diameter of 400 nm from Sakai Chemical Industry Co., Ltd. to prepare a carrier 3 having an Ry of 4 μm, a volume-average particle diameter of 36 μm, and a specific volume resistivity of 12 Log Ω·cm.

Carrier Preparation Example 4

The procedure for preparation of the carrier 2 in Carrier Preparation Example 2 was repeated except for replacing the barium sulfate with a sedimentary barium sulfate 200 having a particle diameter of 800 nm from Sakai Chemical Industry Co., Ltd. to prepare a carrier 4 having an Ry of 4 μm, a volume-average particle diameter of 36 μm, and a specific volume resistivity of 12 Log Ω·cm.

Carrier Preparation Example 5

The procedure for preparation of the carrier 2 in Carrier Preparation Example 2 was repeated except for replacing the barium sulfate with a sedimentary barium sulfate 270 having a particle diameter of 900 nm from Sakai Chemical Industry Co., Ltd. to prepare a carrier 5 having an Ry of 4 μm, a volume-average particle diameter of 36 μm, and a specific volume resistivity of 12 Log Ω·cm.

Carrier Preparation Example 6

The procedure for preparation of the carrier 1 in Carrier Preparation Example 1 was repeated except for stilling the carrier after sieved with a locking mill for 4 hrs to prepare a carrier 6 having an Ry of 5 μm, a volume-average particle diameter of 36 μm, and a specific volume resistivity of 12 Log Ω·cm.

Carrier Preparation Example 7

The procedure for preparation of the carrier 2 in Carrier Preparation Example 2 was repeated except for stirring the carrier after sieved for 4 hrs to prepare a carrier 7 having an Ry of 5 μm, a volume-average particle diameter of 36 and a specific volume resistivity of 12 Log Ω·cm Carrier Preparation Example 8

The procedure for preparation of the carrier 3 in Carrier Preparation Example 3 was repeated except for stirring the carrier after sieved with a locking mill for 4 hrs to prepare a carrier 8 having an Ry of 5 μm, a volume-average particle diameter of 36 μm, and a specific volume resistivity of 12 Log Ω·cm.

Carrier Preparation Example 9

The procedure for preparation of the carrier 4 in Carrier Preparation Example 4 was repeated except for stirring the carrier after sieved with a locking mill for 4 hrs to prepare a carrier 9 having an Ry of 5 μm, a volume-average particle diameter of 36 μm, and a specific volume resistivity of 12 Log Ω·cm.

Carrier Preparation Example 10

The procedure for preparation of the carrier 5 in Carrier Preparation Example 5 was repeated except for stirring the carrier after sieved with a locking mill for 4 hrs to prepare a carrier 10 having an Ry of 5 μm, a volume-average particle diameter of 36 μm, and a specific volume resistivity of 12 Log Ω·cm.

Carrier Preparation Example 11

The following materials were dispersed by a homomixer for 10 min to obtain a covering layer forming solution.

| | |
|---|---|
| Silicone Resin Solution [Solid content of 20% by mass (SR2410 from Dow Corning Toray Silicone Co., Ltd.)] | 500 |
| Titanium Catalyst [Solid content of 60% by mass (TC-754 from Matsumoto Fine Chemical Co., Ltd.)] | 20 |
| Aminosilane [Solid content of 100% by mass (SH6020 from Dow Corning Toray Silicone Co., Ltd.)] | 3.2 |
| Barium Sulfate (Sedimentary barium sulfate 110 having a particle diameter of 600 nm from Sakai Chemical Industry Co., Ltd.) | 130 |
| Carbon Black (EC600JD having a DBP oil absorption 505 ml/100 g from Lion Corp.) | 2 |
| Toluene | 1,000 |

The covering layer forming solution was coated on 5,000 parts of C1 by SPIRA COTA (from Okada Seiko Co., Ltd.) at a an inner temperature of 65° C. and dried. The resultant carrier was burnt in an electric oven at 200° C. for 1 hr. After cooled, the ferrite powder bulk was sieved through openings of 63 μm. The carrier and a toner (2% by mass) were placed in a vial, and stirred by a locking mill from Seiwa Giken Co., Ltd. at 60 Hz for 5 hrs. The toner was removed from the mixture to prepare a carrier 11 having an Ry of 4.5 μm, a volume-average particle diameter of 36 μm, and a specific volume resistivity of 12 Log Ω·cm.

Carrier Preparation Example 12

The procedure for preparation of the carrier 11 in Carrier Preparation Example 11 was repeated except for replacing the barium sulfate with magnesium oxide PSF-150 having a particle diameter of 700 nm from Konoshima Chemical Co., Ltd. to prepare a carrier 12 having an Ry of 4.5 μm, a volume-average particle diameter of 36 μm, and a specific volume resistivity of 12 Log Ω·cm.

Carrier Preparation Example 13

The procedure for preparation of the carrier 11 in Carrier Preparation Example 11 was repeated except for replacing the barium sulfate with hydrotalcite HT-1 having a particle diameter of 600 nm from Sakai Chemical Industry Co., Ltd. to prepare a carrier 13 having an Ry of 4.5 μm, a volume-average particle diameter of 36 μm, and a specific volume resistivity of 12 Log Ω·cm.

Carrier Preparation Comparative Example 1'

The procedure for preparation of the carrier 11 in Carrier Preparation Example 11 was repeated except for stirring the carrier after sieved with a locking mill for 7 hrs to prepare a carrier 1' having an Ry of 3.5 μm, a volume-average particle diameter of 36 μm, and a specific volume resistivity of 12 Log Ω·cm.

Carrier Preparation Comparative Example 2'

The procedure for preparation of the carrier 11 in Carrier Preparation Example 11 was repeated except for not stirring the carrier after sieved with a locking mill to prepare a carrier 2' having an Ry of 5.5 μm, a volume-average particle diameter of 36 μm, and a specific volume resistivity of 12 Log Ω·cm.

Carrier Preparation Comparative Example 3'

The procedure for preparation of the carrier 11 in Carrier Preparation Example 11 was repeated except for mixing the carrier after sieved with a TURBULA mixer from Bachofen AG at 100 rpm for 6 hrs to prepare a carrier 3' having an Ry of 5.5 μm, a volume-average particle diameter of 36 μm, and a specific volume resistivity of 12 Log Ω·cm.

(Toner Preparation Example)

[Synthesis Example of Polyester Resin A]

In a reactor equipped with a thermometer, stirrer, condenser and nitrogen-introducing tube, 443 parts of PO adduct of bisphenol-A (hydroxyl value 320), 135 parts of diethylene glycol, 422 parts of terephthalic acid and 2.5 parts of dibutyltin oxide were placed, and reacted at 200° C. till the acid value became 10 to prepare a [polyester resin A]. The resin had a Tg of 63° C. and a peak number-average molecular weight of 6,000.

[Synthesis Example of Polyester Resin B]

In a reactor equipped with a thermometer, stirrer, condenser and nitrogen-introducing tube, 443 parts of PO adduct of bisphenol-A (hydroxyl value 320), 135 parts of diethylene glycol, 422 parts of terephthalic acid and 2.5 parts of dibutyltin oxide were put, and reacted at 230° C. till the acid value became 7 to prepare a [polyester resin B]. The resin had a Tg of 65° C. and a peak number-average molecular weight of 16,000.

[Preparation of Base Toner Particle 1]

| | |
|---|---|
| Polyester resin A | 40 parts |
| Polyester resin B | 60 parts |
| Carnauba wax (from Cerarica NODA Co., Ltd.) | 1 part |
| Pigment Yellow 155 (from Clariant) | 15 parts |

The above-described toner components were mixed by a Henschel mixer (Henschel 20B manufactured by Mitsui Mining Co., Ltd, 1500 rpm for 3 minutes), and kneaded by a uniaxial kneader (small size Buss co-kneader manufactured by Buss Corporation) in the following condition (preset temperature: inlet zone 100° C., outlet zone 50° C., feed rate: 2 kg/Hr) to prepare a [base toner A1].

Further, after the [base toner A1] was kneaded, it was extended and cooled, crashed by Pulverizer, and further finely crushed by I-system mill (IDS-2 type manufactured by Nippon Pneumatic Co., Ltd., using a planer collision plate, under the condition of air pressure: 6.8 atm/cm$^2$, feed rate: 0.5 kg/hr), further, classified (132MP manufactured by Alpine Corporation) to obtain a [base toner particle 1].

(External Additive Treatment)

To 100 parts of the [base toner particle 1], 1.0 parts of hydrophobic silica fine polder (R972: manufactured by Nippon Aerosil Co., Ltd.) was added as an external additive, and mixed by a Henschel mixer to obtain a toner particle (hereinafter referred to a [toner 1].).

[Preparation of Developer]

To the carriers 1 to 13 and 1' to 3' (93 parts) obtained in Carrier Preparation Examples and Comparative Examples, 7.0 parts of toner 1 (having an average particle diameter of 7.2 μm) obtained in Toner Preparation Example were added, and stirred by a ball mill for 20 minutes to prepare developers 1 to 13 and 1' to 3'. Properties of the developers 1 to 13 and 1' to 3' are shown in Table 1.

TABLE 1

| | Developer | Toner | Carrier | Core Material | Filler | Filler Diameter [nm] | DBP Oil Absorption [ml/100 g] | Ry [μm] | Specific Volume Resistivity [Log Ω · cm] |
|---|---|---|---|---|---|---|---|---|---|
| Example 1 | 1 | 1 | 1 | C1 | Barium Sulfate | 600 | 360 | 4 | 12 |
| Example 2 | 2 | 1 | 2 | C1 | Barium Sulfate | 300 | 400 | 4 | 12 |
| Example 3 | 3 | 1 | 3 | C1 | Barium Sulfate | 400 | 400 | 4 | 12 |
| Example 4 | 4 | 1 | 4 | C1 | Barium Sulfate | 800 | 400 | 4 | 12 |
| Example 5 | 5 | 1 | 5 | C1 | Barium Sulfate | 900 | 400 | 4 | 12 |
| Example 6 | 6 | 1 | 6 | C1 | Barium Sulfate | 600 | 360 | 5 | 12 |
| Example 7 | 7 | 1 | 7 | C1 | Barium Sulfate | 300 | 400 | 5 | 12 |

TABLE 1-continued

| | Developer | Toner | Carrier | Core Material | Filler | Filler Diameter [nm] | DBP Oil Absorption [ml/100 g] | Ry [μm] | Specific Volume Resistivity [Log Ω · cm] |
|---|---|---|---|---|---|---|---|---|---|
| Example 8 | 8 | 1 | 8 | C1 | Barium Sulfate | 400 | 400 | 5 | 12 |
| Example 9 | 9 | 1 | 9 | C1 | Barium Sulfate | 800 | 400 | 5 | 12 |
| Example 10 | 10 | 1 | 10 | C1 | Barium Sulfate | 900 | 400 | 5 | 12 |
| Example 11 | 11 | 1 | 11 | C1 | Barium Sulfate | 600 | 500 | 4.5 | 12 |
| Example 12 | 12 | 1 | 12 | C1 | Magnesium Oxide | 700 | 500 | 4.5 | 12 |
| Example 13 | 13 | 1 | 13 | C1 | Hydrotalcite | 600 | 500 | 4.5 | 12 |
| Comparative Example 1 | 1' | 1 | 1' | C1 | Barium Sulfate | 600 | 500 | 3.5 | 12 |
| Comparative Example 2 | 2' | 1 | 2' | C1 | Barium Sulfate | 600 | 500 | 5.5 | 12 |
| Comparative Example 3 | 3' | 1 | 3' | C1 | Barium Sulfate | 600 | 500 | 5.5 | 12 |

<Image Quality Evaluation>

Images for evaluation were produced by a digital color copier Ricoh Pro C751EX from Ricoh Company, Ltd. under the following conditions.

Development gap (photoconductor-developing sleeve): 0.3 mm

Doctor gap (developing sleeve-doctor): 0.65 mm

Photoconductor linear speed: 440 mm/sec (Developing sleeve linear speed)/(Photoconductor linear speed): 1.80

Writing density: 600 dpi

Charge potential (Vd): −600 V

Potential of image part (solid image) after irradiated: −100 V

Developing bias: DC-500V/AC bias component: 2 KHz, −100 V to −900 V, 50% duty (1) Color Smear After 1,000,000 images were produced under the above conditions, 5 positions of the center of a solid image 30 mm×30 mm (*1) were measured by a spectral colorimetry densitometer X-Rite 938. An average of L*, a*, and b* was determined. A color difference ΔE was determined from these and L*, a*, and b* of reference color. The color smear was evaluated as follows.

*1: part equivalent to developing potential 400V=(irradiated part potential−developing bias DC)=−100V−(−500V)

$$\Delta E^*_{ab}=\sqrt{(\Delta L^*)^2+(\Delta a^*)^2+(\Delta b^*)^2}$$

Not less than 0 to less than 0.2: Excellent

Not less than 0.2 to less than 0.5: Good

Not less than 0.5 to less than 1.0: Fair

Not less than 1.0: Poor

A developer including a carrier without electroconductive carbon and a yellow toner was set in PRETER 500 from Ricoh Company Ltd. to produce an image, and the color of which was used as a reference color.

(2) Carrier Adherence (Solid Part)

Carrier adherence causes damages on a photoconductor drum and a fixing roller, resulting in deterioration of image quality. Even when carriers adhere on the photoconductor, only a part of the carries transfer onto a paper. Therefore, solid carrier adherence was evaluated as follows.

Charge potential (Vd): −600 V

Potential of image part (solid image) after irradiated: −100 V

Developing bias: DC −500V

The number of carriers adhering to a solid image 30 mm×30 mm produced by Ricoh Pro C751EX from Ricoh Company, Ltd. was counted on the photoconductor to evaluate solid carrier adherence. The results after 1,000,000 images were produced are shown in Table 2.

TABLE 2

| | Developer | Color Smear | Solid Carrier Adherence |
|---|---|---|---|
| Example 1 | 1 | Excellent | Fair |
| Example 2 | 2 | Excellent | Fair |
| Example 3 | 3 | Excellent | Good |
| Example 4 | 4 | Excellent | Good |
| Example 5 | 5 | Excellent | Fair |
| Example 6 | 6 | Fair | Fair |
| Example 7 | 7 | Fair | Fair |
| Example 8 | 8 | Fair | Good |
| Example 9 | 9 | Fair | Good |
| Example 10 | 10 | Fair | Fair |
| Example 11 | 11 | Excellent | Excellent |
| Example 12 | 12 | Excellent | Excellent |
| Example 13 | 13 | Excellent | Excellent |
| Comparative Example 1 | 1' | Excellent | Poor |
| Comparative Example 2 | 2' | Poor | Good |
| Comparative Example 3 | 3' | Poor | Good |

Having now fully described the invention, it will be apparent to one of ordinary skill in the art that many changes and modifications can be made thereto without departing from the spirit and scope of the invention as set forth therein.

What is claimed is:

1. A carrier, comprising:

a magnetic core and a covering layer, covering the core and including at least a covering resin, carbon black, and a filler, wherein the carrier has a surface with a maximum height Ry of from 4.0 μm to 5.0 μm, and the filler has a particle diameter of from 400 nm to 800 nm.

2. The carrier of claim 1, wherein the carbon black has a DBP oil absorption of not less than 400 ml/100 g.

3. The carrier of claim 1, wherein the filler is at least one selected from the group consisting of barium sulfate, hydrotalcite and magnesium oxide.

4. A two-component developer, comprising:

the carrier according to claim 1; and a toner.

5. The two-component developer of claim 4, wherein the toner is a color toner.

6. A developer for replenishment, comprising:

the carrier according to claim 1; and a toner in an amount of from 2 to 50 parts by mass relative to 1 part by mass of the carrier.

7. A process cartridge, comprising:

an electrostatic latent image bearer;

a charger to charge a surface of the electrostatic latent image bearer;

an image developer to develop an electrostatic latent image formed on the electrostatic latent image bearer with the two-component developer according to claim 4; and a cleaning member to clean the electrostatic latent image bearer.

8. An image forming apparatus, comprising:

an electrostatic latent image bearer;

a charger to charge a surface of the electrostatic latent image bearer;

an irradiator to irradiate the surface of the electrostatic latent image bearer to form an electrostatic latent image on the surface of the electrostatic latent image bearer;

an image developer to develop the electrostatic latent image with the two-component developer according to claim 4 to foam a toner image;

a transferor to transfer the toner image onto a recording medium; and a fixer to fix the toner image on the recording medium.

9. An image forming method, comprising:

forming an electrostatic latent image on an electrostatic latent image bearer;

developing the electrostatic latent image with the two-component developer according to claim 4 to form a toner image on a surface of the electrostatic latent image bearer;

transferring the toner image onto a recording medium; and fixing the toner image on the recording medium.

10. The carrier of claim 1, wherein the covering resin comprises a silicone resin, an acrylic resin, or a combination thereof.

11. The carrier of claim 1, wherein the covering resin comprises an acrylic resin and the tiller is present in the acrylic resin.

12. The carrier of claim 1, wherein the covering layer further comprises a crosslinked material of an acrylic resin and an amino resin.

13. The carrier of claim 1, wherein the covering layer further comprises a silane coupling agent.

14. The carrier of claim 1, wherein the filler is at least one selected from the group consisting of titanium oxide, tin oxide, zinc oxide, alumina, barium sulfide, magnesium oxide, magnesium hydroxide, and hydrotalcite.

* * * * *